US005593067A

United States Patent [19]

Shaw et al.

[11] Patent Number: 5,593,067

[45] Date of Patent: Jan. 14, 1997

[54] MODULAR DISPENSER FOR FLUENT SOLIDS OR LIQUIDS

[76] Inventors: Teresa M. Shaw, 7804 - 159 Avenue, Edmonton, Alberta, Canada, T5Z 2V7; Barrie J. Shaw, 7804 - 159 Avenue, Edmonton, Alberta, Canada, T5J 2V7

[21] Appl. No.: 350,086

[22] Filed: Nov. 29, 1994

[51] Int. Cl.[6] ..... B67D 1/16

[52] U.S. Cl. ..... 222/108; 222/160; 222/185.1; 222/183; 222/511

[58] Field of Search ..... 222/108, 160, 222/164–166, 181.3, 183, 185.1, 511

[56] References Cited

U.S. PATENT DOCUMENTS

| | | | |
|---|---|---|---|
| 221,143 | 11/1879 | Allen | 222/160 |
| 410,463 | 9/1889 | Stopple et al. | 222/185.1 |
| 1,081,151 | 12/1913 | Ritter | 222/160 X |
| 1,751,535 | 3/1930 | Terborg | 222/511 X |
| 1,939,900 | 12/1933 | Jagy | 222/181.3 |
| 1,988,133 | 1/1935 | Myers | 222/181.3 X |
| 2,354,197 | 7/1944 | Camprell . | |
| 2,410,410 | 11/1946 | Garubo | 222/511 X |
| 2,575,920 | 11/1951 | Kilpatrick et al. . | |
| 2,675,947 | 4/1954 | Wynn, Sr. | 222/511 X |
| 2,770,398 | 11/1956 | Sauerman | 222/181.3 |
| 3,344,958 | 10/1967 | Kaanehe | 222/181.3 |
| 4,287,921 | 9/1981 | Sanford | 222/181.3 X |
| 4,523,547 | 6/1985 | Ogasawara et al. . | |
| 5,022,348 | 6/1991 | Bruecker et al. . | |
| 5,044,483 | 9/1991 | Stefan | 222/160 X |
| 5,447,256 | 9/1995 | Graham | 222/108 |

*Primary Examiner*—Kevin P. Shaver
*Attorney, Agent, or Firm*—George A. Seaby

[57] ABSTRACT

A modular household dispenser for fluent solids or liquids includes a rectangular casing for mounting on a wall or beneath a cupboard, and a hopper slidably mounted in the open front end of the casing. The hopper includes an inverted frusto-pyramidal bottom, the dispensing lower end of which is closed by a valve. Springs bias the valve to a closed position, whereby the valve automatically closes following a dispensing operation. During use, the hopper is slid outwardly to a dispensing position. A small container is located beneath the valve in the dispensing position for receiving any overflow. Upon completion of a dispensing operation, the hopper is slid inwardly to the storage or non-use position. The entire structure is relatively simple, compact and easy to install and use.

8 Claims, 6 Drawing Sheets

MODULAR DISPENSER FOR FLUENT SOLIDS OR LIQUIDS

BACKGROUND OF THE INVENTION

1. Field of the Invention

This invention relates to a dispenser for household use, and in particular to a modular dispenser for fluent solids and liquids.

2. Discussion of the Prior Art

In the average household, there are many products, e.g. solid or liquid detergents which remain in and are dispensed from their original containers, i.e. the containers supplied by the manufacturer. The result is often a mess in a laundry room or at the very least the need for regular wiping of spills.

GENERAL DESCRIPTION OF THE INVENTION

The object of the present invention is to provide a solution to the above defined problem by providing a relatively simple household dispenser for fluent solids or liquids.

Accordingly, the present invention relates to a modular dispenser for a fluent solid or a liquid material comprising casing means for mounting the dispenser on a retaining surface, said casing means having an open front end; hopper means in said casing means; valve means normally closing the bottom end of said hopper means, said hopper means being slidable in said casing means for movement between a storage position in the casing means and a dispensing position in which the hopper extends partially out of said casing means, whereby the valve means is accessible for dispensing material therefrom.

BRIEF DESCRIPTION OF THE DRAWINGS

The invention is described hereinafter in greater detail with reference to the accompanying drawings, which illustrate a preferred embodiment of the invention, and wherein.

DESCRIPTION OF THE PREFERRED EMBODIMENT

Figure 1:
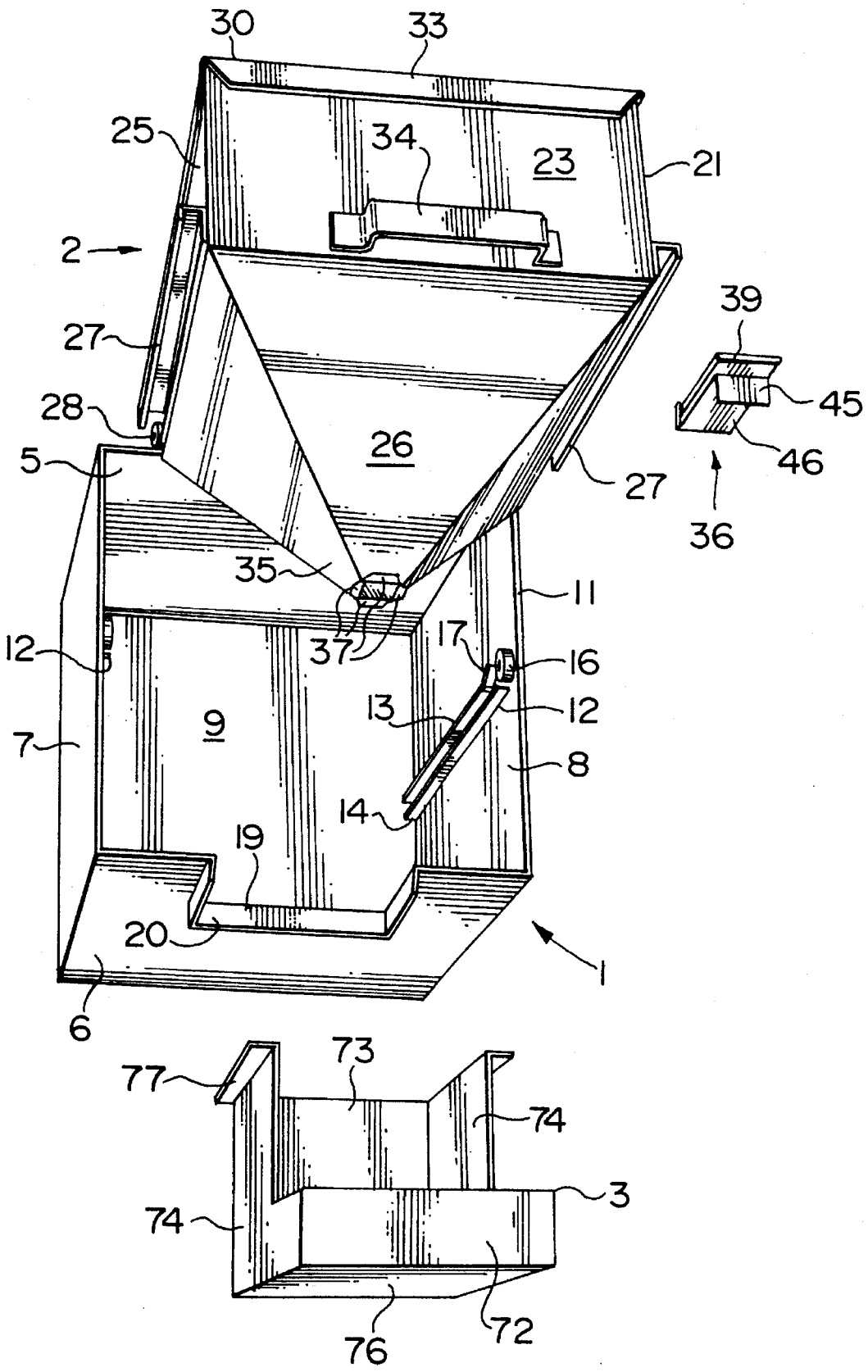
FIG. 1 is an exploded, perspective view of a dispenser in accordance with the present invention.

With reference to FIGS. 1 to 4, the basic elements of the dispenser of the present invention include a casing generally indicated at 1, a hopper generally indicated at 2 and an overflow container 3.

The casing 1 is in the form of a rectangular parallelepiped defined by a top wall 5, a bottom wall 6, side walls 7 and 8, and a rear wall 9. The casing 1 can be suspended beneath a cupboard (not shown) or mounted on a wall (not shown).

Suitable brackets can be provided for such purpose. The casing 1 has an open front end 11 for receiving the hopper 2. Tracks 12 are provided on the inner surface of each side wall 7 and 8 for slidably supporting the hopper 2 in the casing 1. As best shown in FIG. 1, each track 12 is defined by parallel, spaced apart strips 13 and 14, and a roller 16 at the open outer end of the strips for facilitating sliding of the hopper 2 in the casing 1. The front end 17 of the upper strip 13 is bent upwardly for facilitating mounting of the hopper 2 in the casing 1. A recess 19, with a downwardly extending flange 20 therearound, is provided in the front center of the bottom wall 6 for receiving the overflow container 3.

Figure 2:
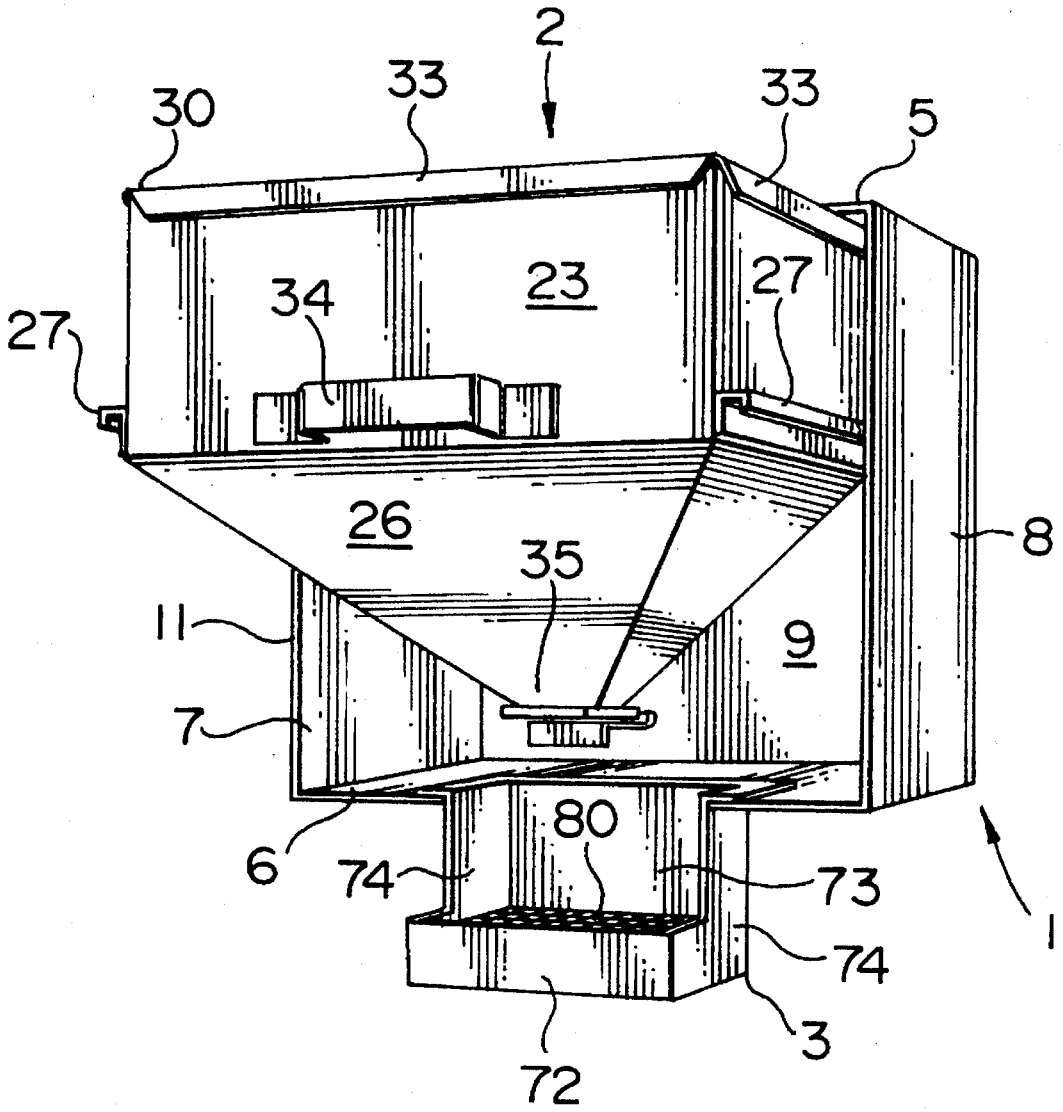
FIG. 2 is a perspective view of the dispenser of FIG. 1 in the assembled condition.
Figure 3:
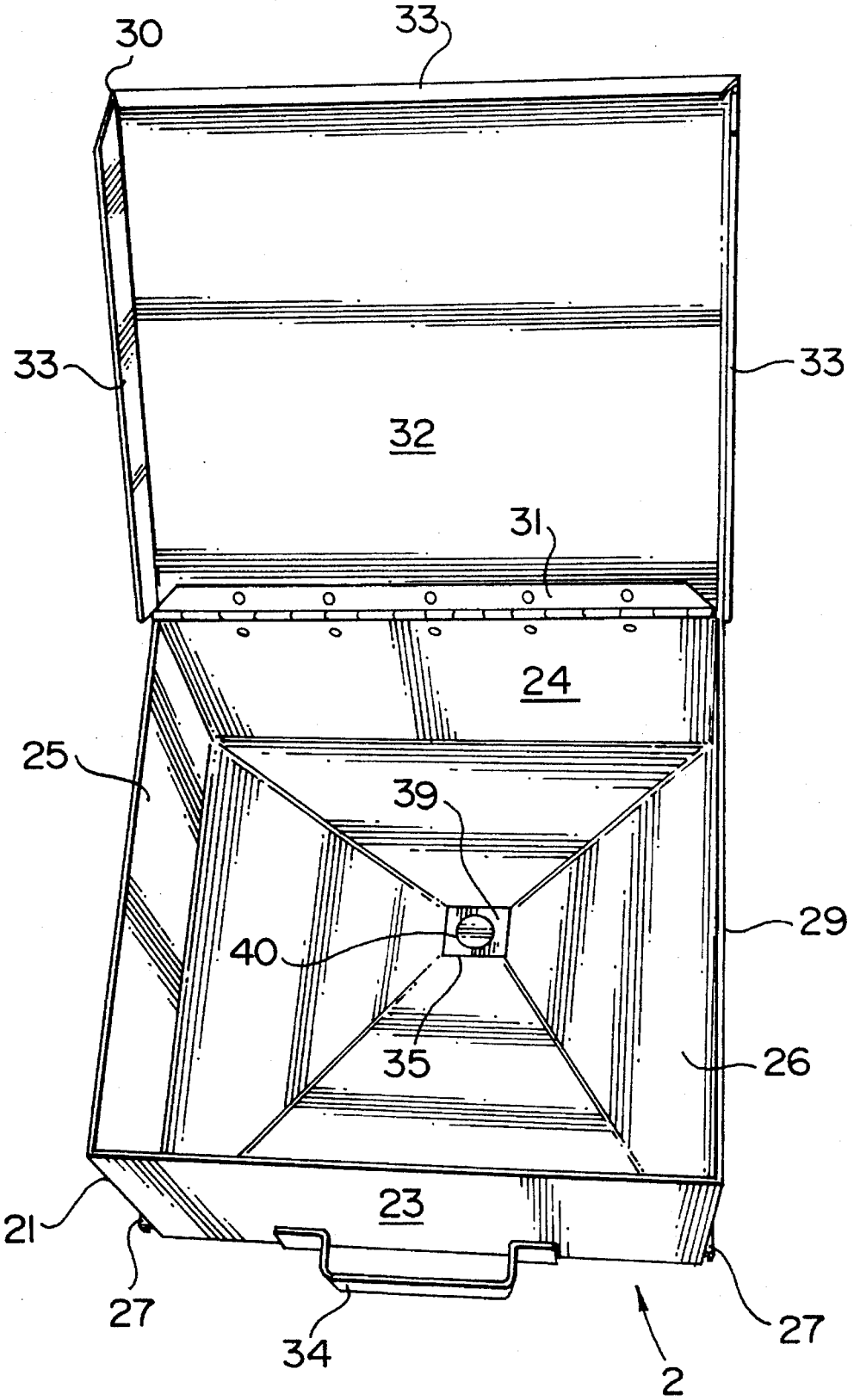
FIG. 3 is a perspective view from above a hopper used in the dispenser of FIGS. 1 and 2.
Figure 4:
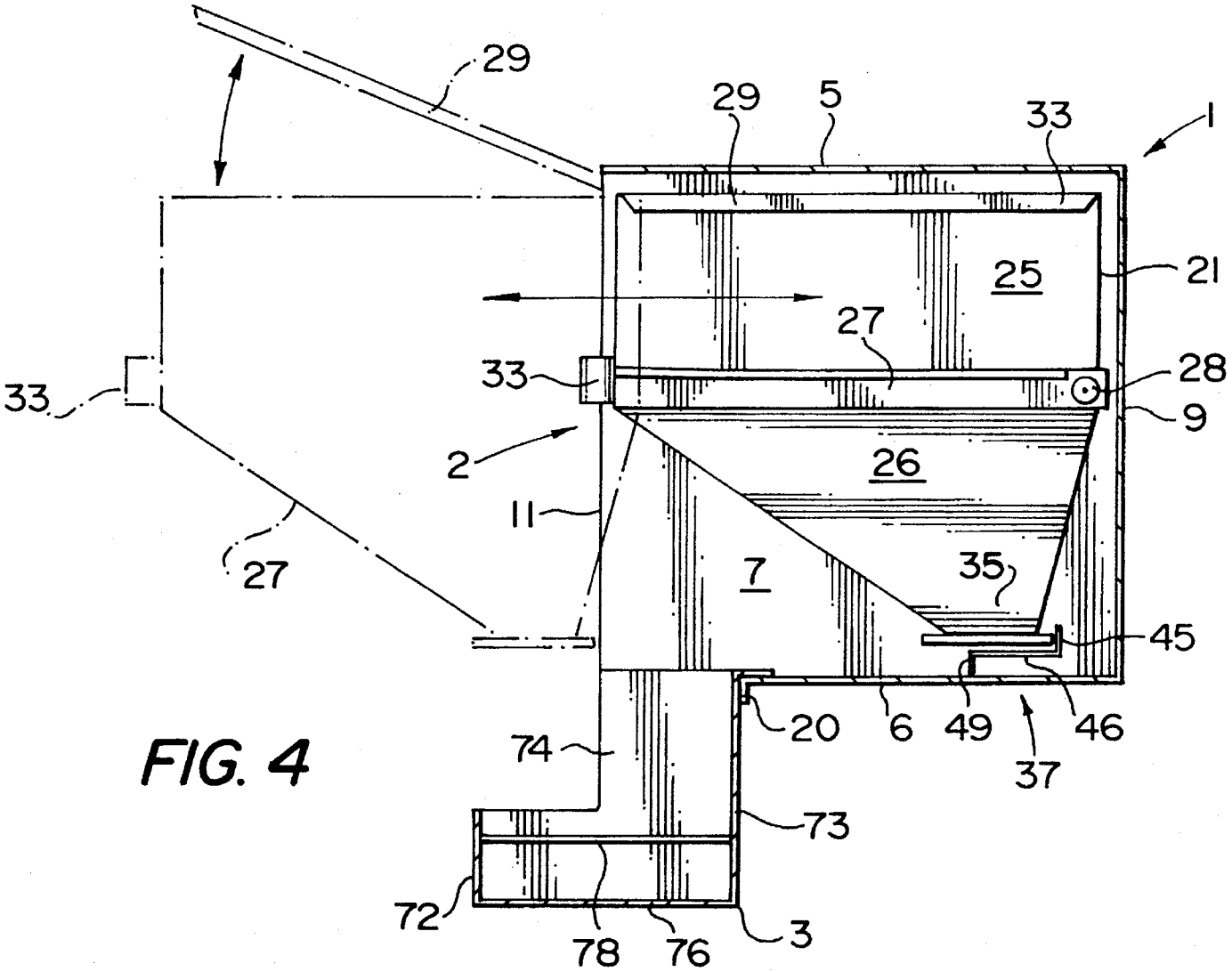
FIG. 4 is a cross-sectional view of the dispenser of FIGS. 1 and 2.

The hopper 2 includes a tubular, rectangular body 21 defined by a front wall 23, a rear wall 24 and side walls 25. A frusto-pyramidal funnel 26 extends downwardly from the bottom end of the body 21. A generally inverted J-shaped strip 27 extends along each side wall 25 of the body 21. The strips 27 define slides for mounting in the tracks 12 of the casing. A roller 28 is mounted on the inner end of each strip 27. The roller 28 acts as a stop for limiting outward movement of the hopper 2. When the hopper 2 is pulled out of the casing 1, the roller 28 hits the roller 16. The open top end 29 of the body 21 is normally closed by a cover 30, which is connected to the rear wall 24 of the body 21 by a piano hinge 31. The cover 30 includes a top panel 32 and flanges 33 for overlapping the front walls 23 and the side walls 25 of the hopper body 21 in the closed position (FIGS. 1, 2 and 4). A handle 34 is provided on the front wall 23 of the hopper body 21 facilitating manual manipulation of the hopper 2.

Figure 5:
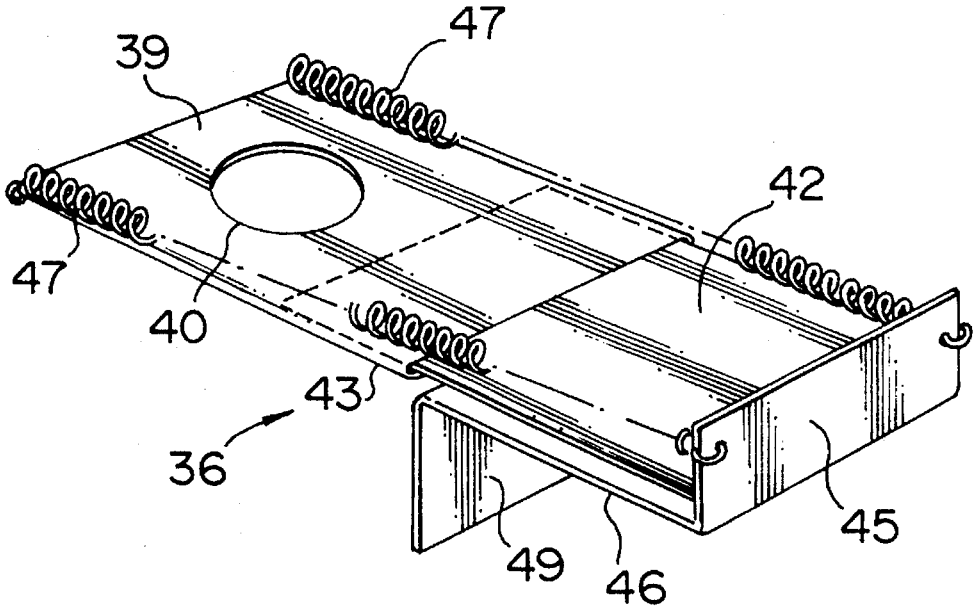
FIG. 5 is a perspective view of a valve for controlling the dispensing of fluent solids from the hopper illustrated in FIGS. 1 to 4.

The open bottom end 35 of the hopper funnel 26 is closed by a valve generally indicated at 36. The valve 36 is mounted on flanges 37 (FIG. 1) extending outwardly from the periphery of such open bottom end 35. As best shown in FIG. 5, the valve 36 includes a plate 39, which is connected to the flanges 37. A hole 40 is provided in the plate 39 through which particulate solid material, e.g. detergent can be discharged from the hopper 2. The hole 40 is normally closed by a gate defined by a second plate 42 which is slidably mounted in tracks 43 defined by bent side edges of the plate 39. The outer end of the plate 42 is connected to an upwardly extending arm 45 on a third plate 46. The arm 45 is connected to the opposite end of the plate 39 by helical springs 47 which bias the plate 42 inwardly to the closed position, i.e. the position in which the plate 42 blocks the opening 40. A second arm 49 extends downwardly from the front end of the plate 46 for actuation of the valve by a cup (not shown) or other receptacle for receiving the solid material from the hopper.

In operation, the cup or other receptacle is pressed against the arm 49 to slide the plate 42 outwardly to open the valve 36 (FIG. 5). When the container is moved away from the arm 49, the springs 47 return the plate 42 to the rest position in which it blocks the opening 40.

Figure 6:
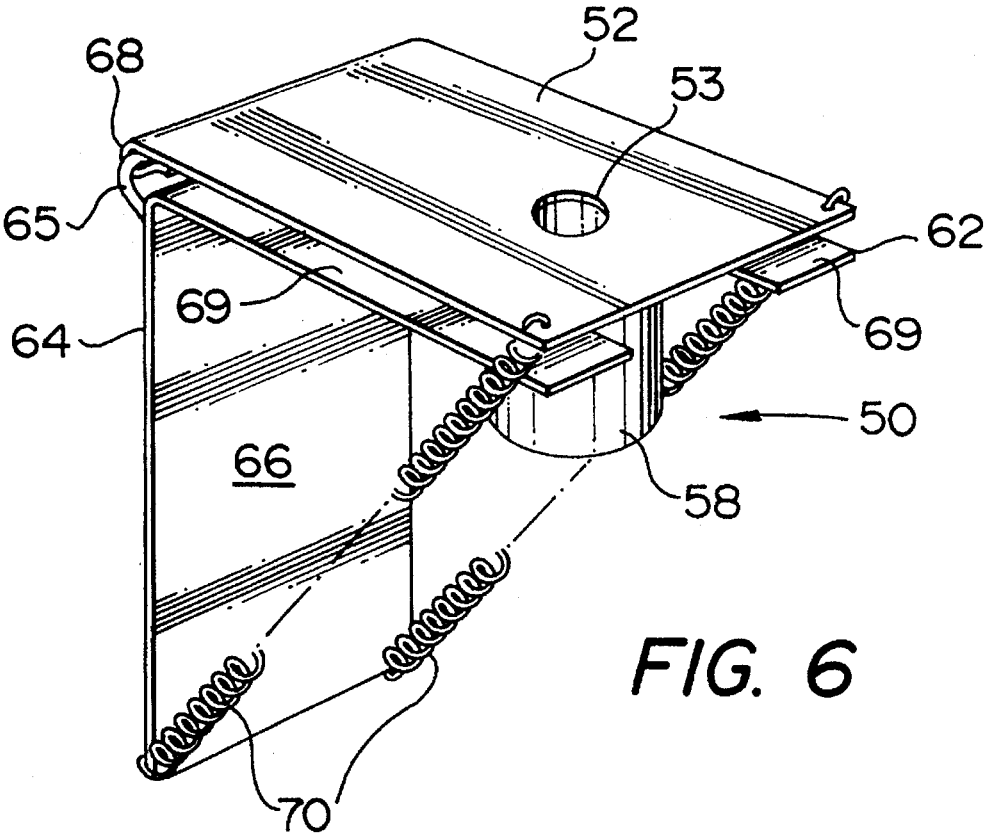
FIG. 6 is a perspective view of a valve for controlling the dispensing of a liquid from the hopper of FIGS. 1 to 4.
Figure 7:
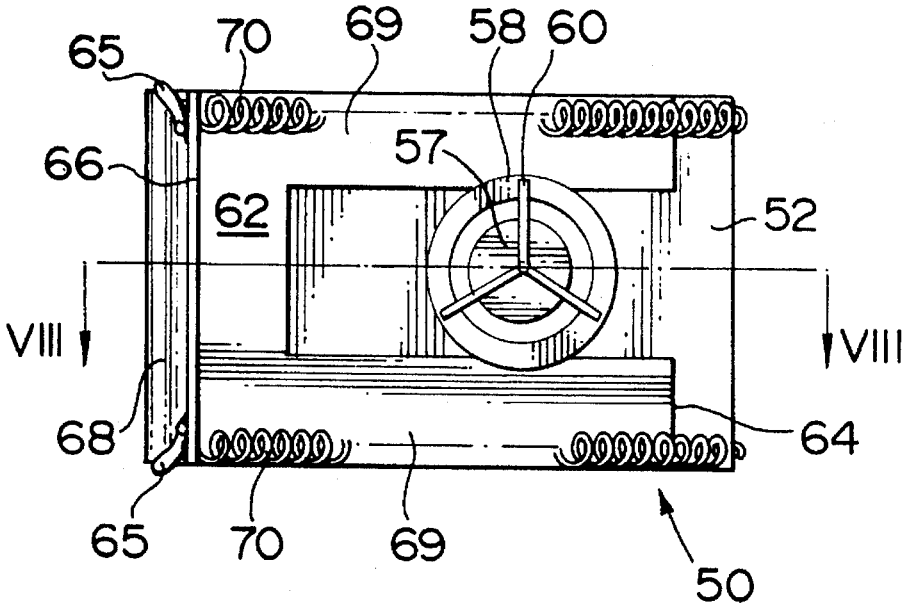
FIG. 7 is a bottom view of the valve of FIG. 6.
Figure 8:
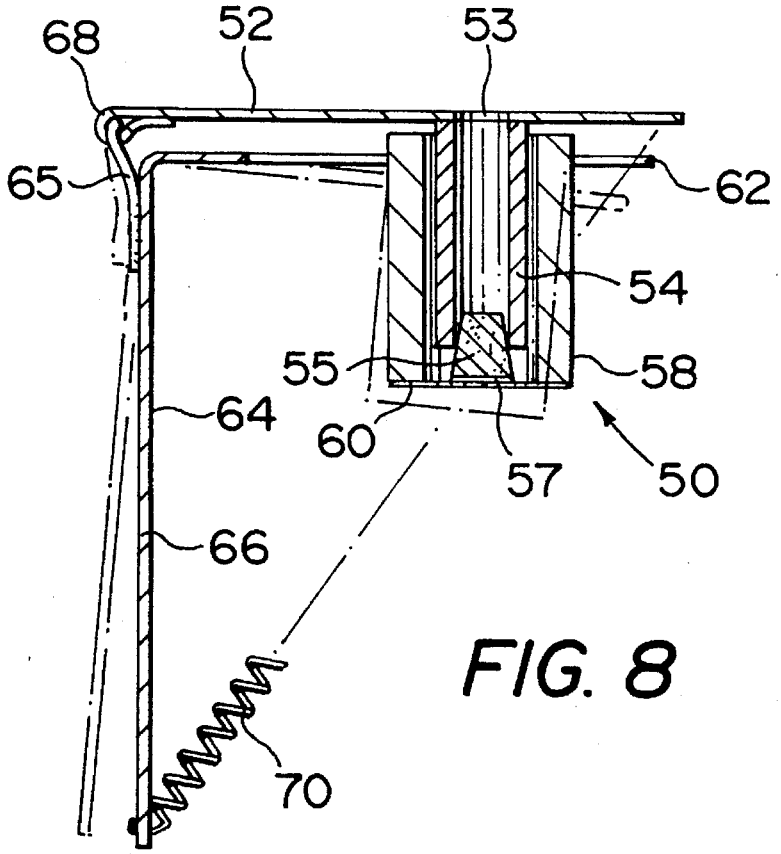
FIG. 8 is a cross section taken generally along line VIII—VIII of FIG. 7.

With reference to FIGS. 6 to 8, a second form of valve generally indicated at 50 which is intended for use when dispensing a liquid from the hopper 2 includes a first plate 52 which (like the plate 39) is mounted on the open bottom end 35 of the hopper 2. Liquid is dispensed through a hole 53 in the plate 42 and a nozzle defined by a tube 54 extending downwardly from the plate around the hole 53. The bottom end of the tube 54 is normally closed by a frusto-conical stopper 55, which is mounted on a plate 57 in the bottom end of a second tube 58. The plate 57 is connected to the tube 58 by a trifurcated wire frame 60. The tube 58, which is coaxial with the tube 54 has an internal diameter which is larger than the external diameter of the tube 54, so that the tube 58 can be pivoted downwardly and rearwardly with respect to the tube 54 to move the stopper 55 partially out of the bottom end of the tube 54, i.e. to open the valve.

The tube 58 is carried by a U-shaped horizontal arm 62 of an inverted L-shaped lever 64. The lever 64 is pivotally connected to the plate 52 by rods 65, which are welded to the vertical arm 66 of the lever 64 and extend into a loop 68 defined by a folded over end of the plate 52. The sides 69 of the horizontal lever arm 62 extend through notches (not shown) in the opposite sides of the tube 58. The vertical arm 66 of the lever 64 extends downwardly so that force can be applied to the lever to pivot the tube 58 to the open position (shown in phantom outline in FIG. 8). The lever 64 and consequently the tube 58 and the stopper 55 are biased to the closed position shown in solid lines in FIG. 8 by a pair of helical springs 70. The springs 70 extend from each side of the front end of the plate 52 to the bottom end of the vertical arm 66 of the lever 64. Thus, when a cup or other container is pressed against the vertical arm 66 of the lever 64 between the springs 70, the lever and consequently the tube 58 are caused to pivot rearwardly to open the valve 50. When the container is removed, the lever 64 is released and the springs 70 return the valve 50 to the closed position.

At the beginning of a dispensing operation, the hopper 2 is slid outwardly from the rest or storage position (shown in solid outline in FIG. 4) to the dispensing position (shown in phantom outline in FIG. 4). When the hopper 2 is in the use position, the valve 36 or 50 is located above the container 3, which is intended to catch any overflow. The container 3 is removably mounted in the recess 19 in the bottom wall 6 of the casing 1. The container 3 is generally L-shaped in cross section, and includes a short front wall 72, a rear wall 73, L-shaped side walls 74 extending between the front and rear walls, and a bottom wall 76. A flange 77 extends outwardly from the upper ends of the rear and side walls for suspending the container 3 in the casing 1. A ledge 78 (FIG. 4) is provided in the container 3 for supporting a screen or grate 80 (FIG. 2).

Thus, there has been described a relatively simple dispenser for household use which is designed to dispense a fluent solid or liquid. While the dispenser is shown as being formed of sheet metal, it will be appreciated that the dispenser can also be produced from plastic.

We claim:

1. A modular dispenser for a fluent solid or a liquid material comprising casing means for mounting the dispenser on a retaining surface, said casing means having an open front end, bottom wall means and recess means in said bottom wall means at said open front end; hopper means in said casing means; valve means normally closing the bottom end of said hopper means, said hopper means being slidable in said casing means for movement between a storage position in the casing means and a dispensing position in which the hopper extends partially out of said casing means, whereby said valve means is accessible in said recess means for dispensing material from said casing means.

2. A dispenser according to claim 1, including overflow container means for removable mounting on said casing means beneath said recess means for receiving any material overflowing during a dispensing operation.

3. A dispenser according to claim 1, wherein said casing means includes side wall means; and track means on said side wall means for slidably supporting said hopper means, and said hopper means includes slide means for sliding on said track means.

4. A dispenser according to claim 3, wherein said casing means is rectangular, and said hopper means includes rectangular cross section body means; and frusto-pyramidal funnel means on the bottom end of said body means, said funnel means normally closed by said valve means.

5. A dispenser according to claim 4, including handle means on said body means for manually moving said hopper means on said track means.

6. A dispenser according to claim 1, wherein said valve means includes gate means movably mounted on the bottom end of said hopper means; and spring means biasing said gate means to a closed position, whereby said gate means can be moved to an open position by exerting a force thereon, and will automatically return to the closed position when the force is released.

7. A dispenser according to claim 6, including arm means extending downwardly from said gate means for actuation by a receptacle intended to receive a solid material from said hopper means.

8. A dispenser according to claim 6, wherein said valve means includes plate means on the bottom end of said hopper means; nozzle means extending downwardly from said plate means for dispensing liquid from said hopper means; lever means pivotally connected to said plate means; and stopper means on said lever means, said spring means extending between said plate means and said lever means for biasing said stopper means to a closed position in said nozzle means, whereby, when a force is exerted on said lever means to pivot the latter relative to said plate means, said stopper means is moved to open said nozzle means, and said spring means will automatically return the stopper means to the closed position when the force is released.

* * * * *